US007801733B2

(12) United States Patent
Lee et al.

(10) Patent No.: US 7,801,733 B2
(45) Date of Patent: Sep. 21, 2010

(54) HIGH-BAND SPEECH CODING APPARATUS AND HIGH-BAND SPEECH DECODING APPARATUS IN WIDE-BAND SPEECH CODING/DECODING SYSTEM AND HIGH-BAND SPEECH CODING AND DECODING METHOD PERFORMED BY THE APPARATUSES

(75) Inventors: Kangeun Lee, Gangneung-si (KR); Changyong Son, Gunpo-si (KR); Insung Lee, Daejeon-si (KR); Jaehyun Shin, Cheongju-si (KR); Jonghun Kim, Cheongju-si (KR); Kyuhyuk Jung, Daejeon-si (KR); Youngwook Ahn, Daejeon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1326 days.

(21) Appl. No.: 11/285,183

(22) Filed: Nov. 23, 2005

(65) Prior Publication Data

US 2006/0149538 A1 Jul. 6, 2006

(30) Foreign Application Priority Data

Dec. 31, 2004 (KR) ..... 10-2004-0117965

(51) Int. Cl.
*G10L 19/00* (2006.01)

(52) U.S. Cl. ..... 704/500; 704/201

(58) Field of Classification Search ..... None
See application file for complete search history.

(56) References Cited

U.S. PATENT DOCUMENTS 6,611,800 B1 8/2003 Nishiguchi et al.

(Continued)

FOREIGN PATENT DOCUMENTS

KR 2002-0022257 3/2002

(Continued)

OTHER PUBLICATIONS

Laflamme et al., "Harmonic-stochastic excitation (HSX) speech coding below 4 kbit/s", IEEE International Conference on Acoustics, Speech, and Signal Processing, vol. 1, pp. 204-207, May 7-10, 1996.*

(Continued)

*Primary Examiner*—Brian L Albertalli
(74) *Attorney, Agent, or Firm*—Staas & Halsey LLP

(57) ABSTRACT

A high-band speech encoding apparatus and a high-band speech decoding apparatus that can reproduce high quality sound even at a low bitrate when wideband speech encoding and decoding using a bandwidth extension function, and a high-band speech encoding and decoding method performed by the apparatuses. The high-band speech encoding apparatus includes: a first encoding unit encoding a high-band speech signal based on a structure in which a harmonic structure and a stochastic structure are combined, if the high-band speech signal has a harmonic component; and a second encoding unit encoding a high-band speech signal based on a stochastic structure if the high-band speech signal has no harmonic components. The high-band speech decoding apparatus includes: a first decoding unit decoding a high-band speech signal based on a combination of a harmonic structure and a stochastic structure using received first decoding information; a second decoding unit decoding the high-band speech signal based on a stochastic structure using received second decoding information; and a switch outputting one of the decoded high-band speech signals received from the first and second decoding units according to received mode selection information.

35 Claims, 9 Drawing Sheets

U.S. PATENT DOCUMENTS

| | | | | |
|---|---|---|---|---|
| 7,136,810 | B2 * | 11/2006 | Paksoy et al. | 704/219 |
| 7,205,910 | B2 * | 4/2007 | Honma et al. | 341/50 |
| 7,245,234 | B2 * | 7/2007 | Kim et al. | 341/50 |
| 7,330,814 | B2 * | 2/2008 | McCree | 704/219 |
| 7,376,554 | B2 * | 5/2008 | Ojala et al. | 704/207 |
| 2004/0024593 | A1 | 2/2004 | Tsuji et al. | |

FOREIGN PATENT DOCUMENTS

| | | |
|---|---|---|
| WO | WO 00/42601 | 7/2000 |

OTHER PUBLICATIONS

Hernandez-Gomez, L. A. et al.: "Real-time implementation and evaluation of variable rate CELP coders", International Conference on Acoustics, Speech & Signal Processing. ICASSP, vol. Conf. 16, May 14, 1991, pp. 585-588.

Verma T. S. et al: "Sinusoidal modeling using frame-based perceptually weighted matching pursuits," IEEE International Conference on Acoustics, Speech, and Signal Processing, 1999. Proceedings., vol. , Mar. 15, 1999, pages, Phoenix AZ, USA.

European Search Report mailed on Aug. 7, 2008 issued with respect to the corresponding European Patent Application No. 05257978.6-1224.

* cited by examiner

HIGH-BAND SPEECH CODING APPARATUS AND HIGH-BAND SPEECH DECODING APPARATUS IN WIDE-BAND SPEECH CODING/DECODING SYSTEM AND HIGH-BAND SPEECH CODING AND DECODING METHOD PERFORMED BY THE APPARATUSES

CROSS-REFERENCE TO RELATED APPLICATION

This application claims the benefit of Korean Patent Application No. 10-2004-0117965, filed on Dec. 31, 2004, in the Korean Intellectual Property Office, the disclosure of which is incorporated herein by reference.

BACKGROUND OF THE INVENTION

1. Field of the Invention

The present invention relates to speech encoding and decoding, and more particularly, to a high-band speech encoding apparatus and a high-band speech decoding apparatus in wideband speech encoding and decoding with a bandwidth extension function, and a high-band speech encoding and decoding methods performed by the apparatuses.

2. Description of Related Art

As the field of application of speech communications broadens, and the transmission speed of networks improves, and the necessity for high-quality speech communications becomes more imminent. The transmission of a wide-band speech signal having a frequency range of 0.3 to 7 kHz, which is excellent in various aspects such as naturalness and clearness compared to an existing speech communication frequency range of 0.3 to 3.4 kHz, will be required.

On a network side, a packet switching network which transmits data on a packet-by-packet basis may cause congestion in a channel, and consequently, damage to packets and degradation of the quality of sound may occur. To solve these problems, a technique of hiding a damaged packet is used, but this is not a fundamental solution.

Accordingly, a wideband speech encoding/decoding technique that can effectively compress the wideband speech signal and also solve the congestion of a channel has been proposed.

Currently-proposed wideband speech encoding/decoding techniques may be classified into a technique of encoding a complete speech signal having a frequency range of 0.3 to 7 kHz all at a time and decoding the encoded speech signal and a technique of hierarchically encoding frequency ranges of 0.3 to 4 kHz and 4 to 7 kHz into which the speech signal having the frequency range of 0.3 to 7 kHz is divided, and decoding the encoded speech signal. The latter technique is a wideband speech encoding and decoding technique using a bandwidth extension function that achieves optimal communication under a given channel environment by adjusting the amount of data transmitted by layers according to a degree of congestion of a channel.

In the wideband speech encoding using the bandwidth extension function, a high-band speech signal having a frequency range of 4 to 7 kHz is encoded using a modulated lapped transform (MLT) technique. A high-band speech encoding apparatus employing the MLT technique is the same as a high-band speech encoding apparatus 100 shown in FIG. 1.

Referring to FIG. 1, the high-band speech encoding apparatus 100 includes an MLT unit 101 that receives a high-band speech signal and performs MLT on the high-band speech signal to extract an MLT coefficient. The amplitude of the MLT coefficient is output to a 2 dimension-discrete cosine transform (2D-DCT) module 102, and a sign of the MLT coefficient is output to a sign quantizer 103.

The 2D-DCT module 102 extracts 2D-DCT coefficients from the amplitude of the received MLT coefficient and outputs the 2D-DCT coefficients to a DCT coefficient quantizer 104. The DCT coefficient quantizer 104 orders the 2D-DCT coefficients from a 2D-DCT coefficient with a largest amplitude to a 2D-DCT coefficient with a smallest amplitude, quantizes the ordered 2D-DCT coefficients, and outputs a codebook index for the quantized 2D-DCT coefficients. The sign quantizer 103 quantizes a sign of the MLT coefficient having the largest amplitude.

The codebook index and the quantized sign are transmitted to a high-band speech decoding apparatus 110, which decodes the encoded high-band speech signal through a process performed in the opposite order to the process of the high-band speech encoding apparatus 100 and outputs a decoded high-band speech signal.

However, when a speech signal is transmitted at a low bitrate, the high-band speech signal encoding based on the MLT technique cannot guarantee restoration of high-quality sound. As the bitrate decreases, the degradation of sound restoration performance becomes prominent.

BRIEF SUMMARY

An aspect of the present invention provides a high-band speech encoding apparatus and a high-band speech decoding apparatus that can reproduce high quality sound even at a low bitrate in wideband speech encoding and decoding having a bandwidth extension function, and a high-band speech encoding and decoding method performed by the apparatuses.

An aspect of the present invention also provides a high-band speech encoding apparatus and a high-band speech decoding apparatus whose operations depend on whether a high-band speech signal includes a harmonic component in wideband speech encoding and decoding having a bandwidth extension function, and a high-band speech encoding and decoding method performed by the apparatuses.

An aspect of the present invention also provides a high-band speech encoding apparatus and a high-band speech decoding apparatus that can obtain an accurate harmonic amplitude and phase independently of a frequency resolution and complexity in wideband speech encoding and decoding having a bandwidth extension function, and a high-band speech encoding and decoding method performed by the apparatuses.

According to an aspect of the present invention, there is provided a high-band speech encoding apparatus in a wideband speech encoding system, the apparatus comprising: a first encoding unit encoding a high-band speech signal based on a structure in which a harmonic structure and a stochastic structure are combined, if the high-band speech signal has a harmonic component; and a second encoding unit encoding a high-band speech signal based on a stochastic structure if the high-band speech signal has no harmonic components.

According to another aspect of the present invention, there is provided a wideband speech encoding system comprising: a band division unit dividing a speech signal into a high-band speech signal and a low-band speech signal; a low-band speech signal encoding apparatus encoding the low-band speech signal received from the band division unit and outputting a pitch value of the low-band speech signal that is detected through the encoding; and a high-band speech signal encoding apparatus encoding the high-band speech signal using the high-band and low-band speech signals received from the band division unit and the pitch value of the low-band speech signal.

According to another aspect of the present invention, there is provided a high-band speech decoding apparatus comprising: a first decoding unit decoding a high-band speech signal based on a combination of a harmonic structure and a stochastic structure using received first decoding information; a second decoding unit decoding the high-band speech signal based on a stochastic structure using received second decoding information; and a switch outputting one of the decoded high-band speech signals received from the first and second decoding units according to received mode selection information.

According to another aspect of the present invention, there is provided a wideband speech decoding system comprising: a high-band speech signal decoding apparatus decoding a high-band speech signal using decoding information received via a channel using one of a stochastic structure and a combination of a harmonic structure and the stochastic structure; a low-band speech signal decoding apparatus decoding a low-band speech signal using decoding information received via the channel; and a band combination unit combining the decoded high-band speech signal with the decoded low-band speech signal to output a decoded speech signal.

According to another aspect of the present invention, there is provided a high-band speech encoding method in a wideband speech encoding system, comprising: determining whether a high-band speech signal and a low-band speech signal have harmonic components; encoding the high-band speech signal based on a combination of a harmonic structure and a stochastic structure if both the high-band and low-band speech signals have harmonic components; and encoding the high-band speech signal based on a stochastic structure if any one of the high-band and low-band speech signals does not have a harmonic component.

According to another aspect of the present invention, there is provided a high-band speech decoding method, comprising: analyzing mode selection information included in received decoding information; decoding a high-band speech signal based on the received decoding information using a combination of a harmonic structure and a stochastic structure if the mode selection information represents a mode in which a harmonic structure and a stochastic structure are combined; and decoding the high-band speech signal based on the received decoding information using a stochastic structure if the mode selection information represents a stochastic structure.

Additional and/or other aspects and advantages of the present invention will be set forth in part in the description which follows and, in part, will be obvious from the description, or may be learned by practice of the invention.

BRIEF DESCRIPTION OF THE DRAWINGS

Additional and/or other aspects and advantages of the present invention will be set forth in part in the description which follows and, in part, will be obvious from the description, or may be learned by practice of the invention.

DETAILED DESCRIPTION OF EMBODIMENTS

Figure 1:
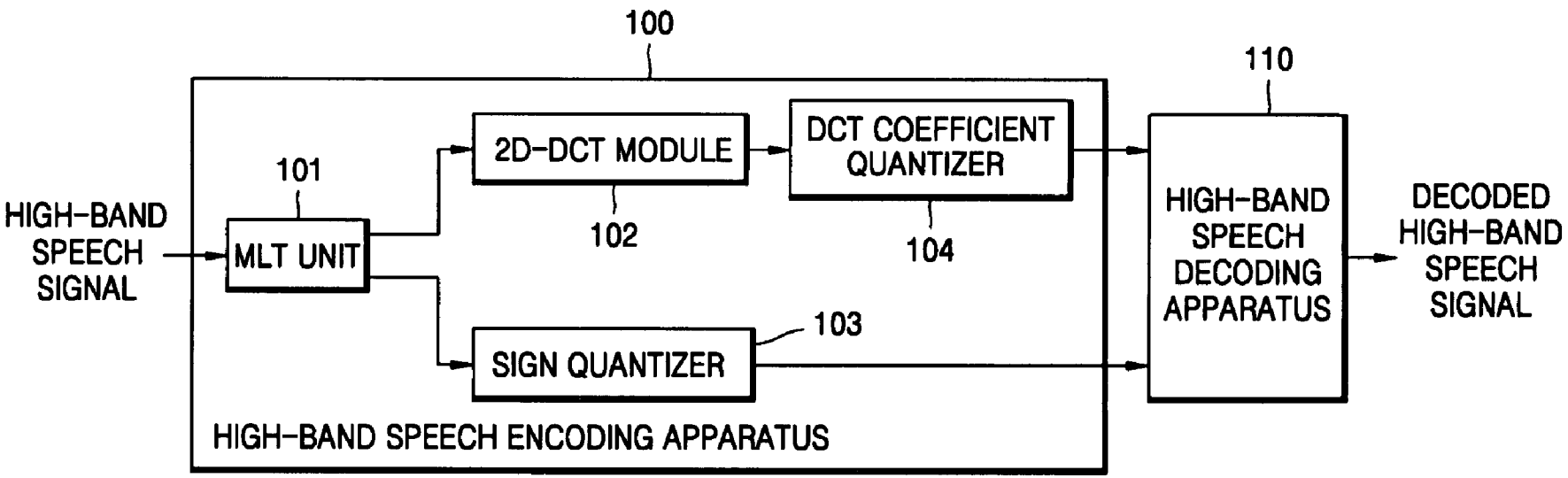
FIG. 1 (PRIOR ART)
FIG. 1 is a block diagram of a conventional high-band speech encoding and decoding apparatus.

Reference will now be made in detail to embodiments of the present invention, examples of which are illustrated in the accompanying drawings, wherein like reference numerals refer to the like elements throughout. The embodiments are described below in order to explain the present invention by referring to the figures.

Figure 2:
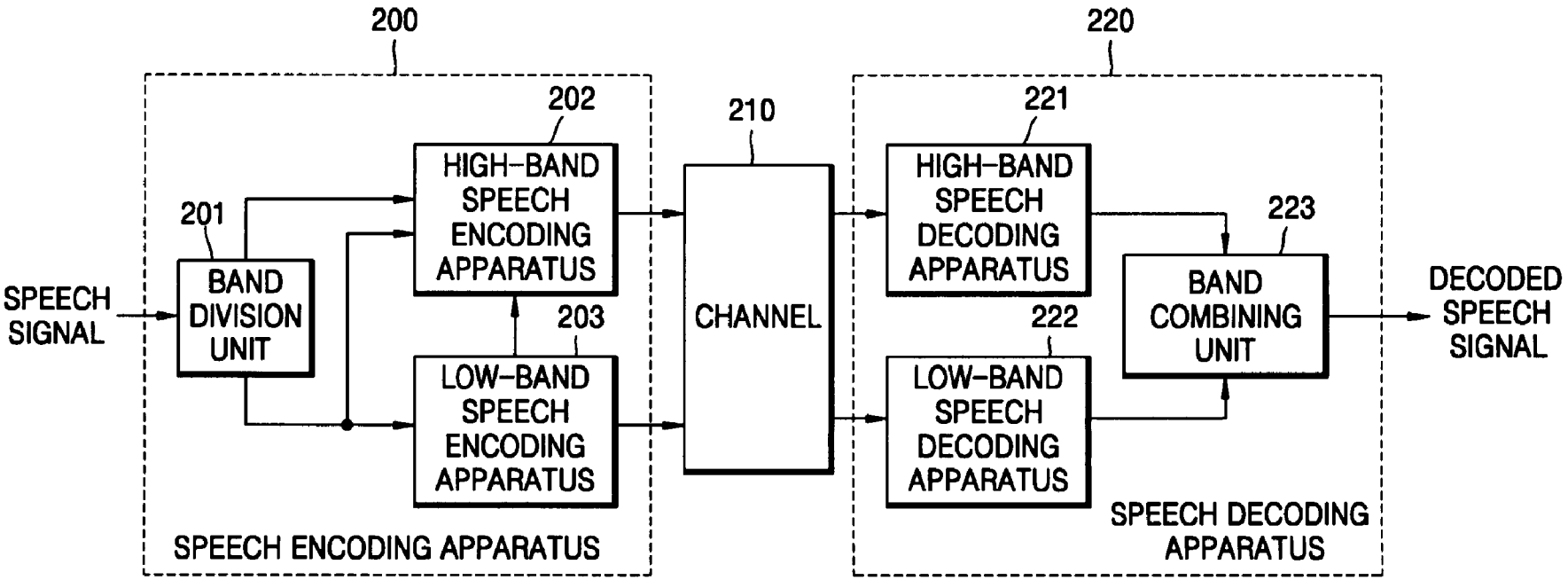
FIG. 2 is a block diagram of a wideband speech encoding/decoding system including a high-band speech encoding apparatus and a high-band speech decoding apparatus according to an embodiment of the present invention.

FIG. 2 is a block diagram of a wideband speech encoding/decoding system including a high-band speech encoding apparatus 202 and a high-band speech decoding apparatus 221 according to an embodiment of the present invention. This wideband speech encoding/decoding system includes a speech encoding apparatus 200, a channel 210, and a speech decoding apparatus 220. Since the wideband speech encoding/decoding system of FIG. 2 has a bandwidth extension function, the speech encoding apparatus 200 includes a band division unit 201, the high-band speech encoding apparatus 202, and a low-band speech encoding apparatus 203.

The band division unit 201 divides a received speech signal into a high-band speech signal and a low-band speech signal. The received speech signal may have a 16-bit linear pulse code modulation (PCM) format. The band division unit 201 outputs the high-band speech signal to the high-band speech encoding apparatus 202 and the low-band speech signal to both the high-band speech encoding apparatus 202 and the low-band speech encoding apparatus 203.

The high-band speech encoding apparatus 202 encodes the high-band speech signal. To do this, the high-band speech encoding apparatus 202 may be constructed as shown in FIG. 3.

Figure 3:
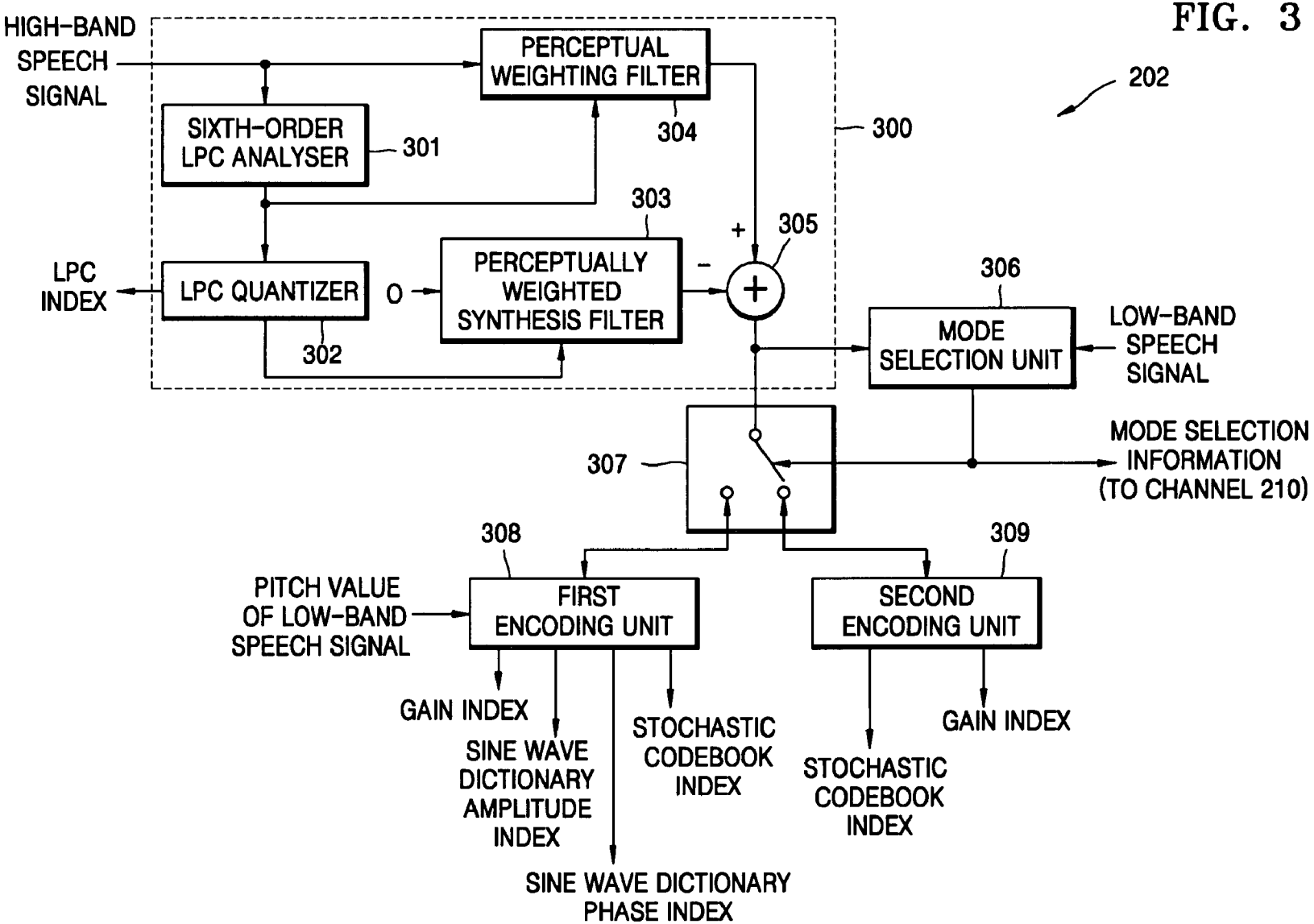
FIG. 3 is a function block diagram of the high-band speech encoding apparatus illustrated in FIG. 2.

Referring to FIG. 3, the high-band speech encoding apparatus 202 includes a zero-state high-band speech signal generating unit 300, a mode selection unit 306, a switch 307, a first encoding unit 308, and a second encoding unit 309.

The zero-state high-band speech signal generating unit 300 transforms the high-band speech signal into a zero-state high-band speech signal. To do this, the zero state high-band speech signal production unit 300 includes a sixth-order linear prediction coefficient (LPC) analyser 301, an LPC quantizer 302, a perceptually weighted synthesis filter 303, a perceptual weighting filter 304, and a subtractor 305.

When the high-band speech signal is received, the sixth-order LPC analyzer 301 obtains 6 LPCs using an autocorrelation technique and a Levison-Durbin algorithm. The 6 LPCs are transmitted to the LPC quantizer 302.

The LPC quantizer 302 transforms the 6 LPCs into line spectral pair (LSP) vectors and quantizes the LSP vectors using a multi-level vector quantizer. The LPC quantizer 302 transforms the quantized LSP vectors back into the LPCs and outputs the LPCs to the perceptually weighted synthesis filter 303. The quantized LSP vectors are output as an LPC index to the channel 210.

The perceptually weighted synthesis filter 303 generates a response signal for an input "0" according to the LPCs received from the LPC quantizer 302 and outputs the response signal to the subtractor 305.

The perceptual weighting filter 304 outputs a perceptually weighted speech signal corresponding to the received high-band speech signal using the 6 LPCs from the sixth-order LPC analyzer 301. The perceptual weighting filter 304 produces quantization noise at a level less than or equal to a masking level by using a hearing masking effect. The perceptually weighted speech signal is transmitted to the subtractor 305.

The subtractor 305 outputs a perceptually weighted speech signal from which the response signal for the "0" input is subtracted. Hence, the perceptually weighted speech signal output by the subtractor 305 is a zero-state high-band speech signal. The perceptually weighted zero-state high-band speech signal output by the subtractor 305 is transmitted to the mode selection unit 306 and the switch 307.

The mode selection unit 306 determines whether the high-band speech signal has a harmonic component using the perceptually weighted zero-state high-band speech signal received from the subtractor 305 and the low-band speech signal received from the band division unit 201, and outputs mode selection information depending on the result of the determination.

More specifically, the mode selection unit 306 obtains predetermined characteristic values of the perceptually weighted zero-state high-band speech signal received from the subtractor 305 and predetermined characteristic values of the low-band speech signal received from the band division unit 201. These characteristic values may be a sharpness rate, a signal left-to-right energy ratio, a zero-crossing rate, and a first-order prediction coefficient.

When the perceptually weighted zero-state high-band speech signal received from the subtractor 305 is s(n), the mode selection unit 306 calculates a sharpness rate, $S_r$, of the perceptually weighted zero-state high-band speech signal using Equation 1:

$$S_r = \frac{\sum_{n=0}^{L_{sf}-1} |s(n)|}{L_{sf} \max_{n=0,\ldots,L_{sf}-1} |s(n)|} \tag{1}$$

wherein $L_{sf}$ denotes the length of a sub-frame. The length of a sub-frame may be expressed as the number of samples. A sub-frame is a part of a frame, and a frame may be divided into two sub-frames.

Next, the mode selection unit 306 calculates a left-to-right energy rate, $E_r$, of the perceptually weighted zero-state high-band speech signal s(n) using Equation 2:

$$E_r = 1 - \left| \frac{\sum_{n=0}^{\frac{L_{sf}}{2}-1} s^2(n) - \sum_{n=\frac{L_{sf}}{2}}^{L_{sf}-1} s^2(n)}{\sum_{n=0}^{\frac{L_{sf}}{2}-1} s^2(n) + \sum_{n=\frac{L_{sf}}{2}}^{L_{sf}-1} s^2(n)} \right| \tag{2}$$

Thereafter, the mode selection unit 306 calculates a zero-crossing rate, $Z_r$, which denotes a degree to which a sign of the perceptually weighted zero-state high-band speech signal s(n) changes per sub-frame, using Equation 3:

$$\begin{aligned} &Z_r = 0 \\ &\text{for } i = L_{sf} - 1 \text{ to } 1 \\ &\text{if } s(i)s(i-1) < 0 \\ &Z_r = Z_r + 1 \\ &Z_r = Z_r / L_{sf} \end{aligned} \tag{3}$$

As shown in Equation 3, the zero-crossing rate $Z_r$ for each sub-frame starts from 0. Since the zero-crossing rate is detected during each sub-frame, i ranges from $L_{sf}-1$ to 1. If a product of an output signal, s(i), of an i-th subtractor 305 and an output signal, s(i−1), of an (i−1)th subtractor 305 is less than 0, zero crossing occurs. Hence, the zero-crossing rate $Z_r$ increases by one. The zero-crossing rate $Z_r$ of a high-band speech signal in a sub-frame is obtained by dividing the zero-crossing rate $Z_r$ finally detected in the sub-frame by the length, $L_{sf}$, of the sub-frame.

Finally, the mode selection unit 306 calculates a first-order prediction coefficient, $C_r$, of the perceptually weighted zero-state high-band speech signal s(n) using Equation 4:

$$C_r = \frac{\sum_{n=0}^{L_{sf}-2} s(n)s(n+1)}{\sum_{n=0}^{L_{sf}-1} s^2(n)} \tag{4}$$

As the correlation between adjacent samples increases, the first-order prediction coefficient $C_r$ increases. As the correlation between adjacent samples decreases, the first-order prediction coefficient $C_r$ decreases.

The mode selection unit 306 compares the characteristic values $S_r$, $E_r$, $Z_r$, and $C_r$ detected during each sub-frame with pre-set characteristic threshold values $T_S$, $T_E$, $T_Z$, and $T_C$ to determine whether the conditions defined in Equation 5 are satisfied:

$$S_r < T_S,\ E_r < T_E,\ Z_r < T_Z, \text{ and } C_r < T_C \tag{5}$$

If the conditions defined in Equation 5 are satisfied, the mode selection unit 306 determines that the high-band speech signal has a harmonic component.

The mode selection unit 306 also obtains four characteristic values per sub-frame for the low-band speech signal as defined in Equations 1 through 4.

More specifically, the mode selection unit 306 compares the characteristic values of the low-band speech signal obtained using Equations 1 through 4 with pre-set threshold characteristic values for the low-band speech signal to determine whether the conditions defined in Equation 5 are satisfied. If the conditions defined in Equation 5 are satisfied, the mode selection unit 306 determines that the low-band speech signal has a harmonic component.

On the other hand, if the conditions defined in Equation 5 are not satisfied, the mode selection unit 306 determines that the low-band speech signal has no harmonic components.

When it is determined that both the high-band speech signal and the low-band speech signal include harmonic components, the mode selection unit 306 outputs mode selection information that controls the switch 307 to transmit the perceptually weighted zero-state high-band speech signal received from the subtractor 305 to the first encoding unit 308. Otherwise, the mode selection unit 306 outputs mode selection information that controls the switch 307 to transmit the perceptually weighted zero-state high-band speech signal received from the subtractor 305 to the second encoding unit 309. The mode selection information is also transmitted to the channel 210.

The first encoding unit 308 synthesizes an excitation signal and the perceptually weighted zero-state high-band speech signal by combining a harmonic structure and a stochastic structure during each sub-frame. Accordingly, the first encoding unit 308 may be defined as an excitation signal synthesizing unit.

Figure 4:
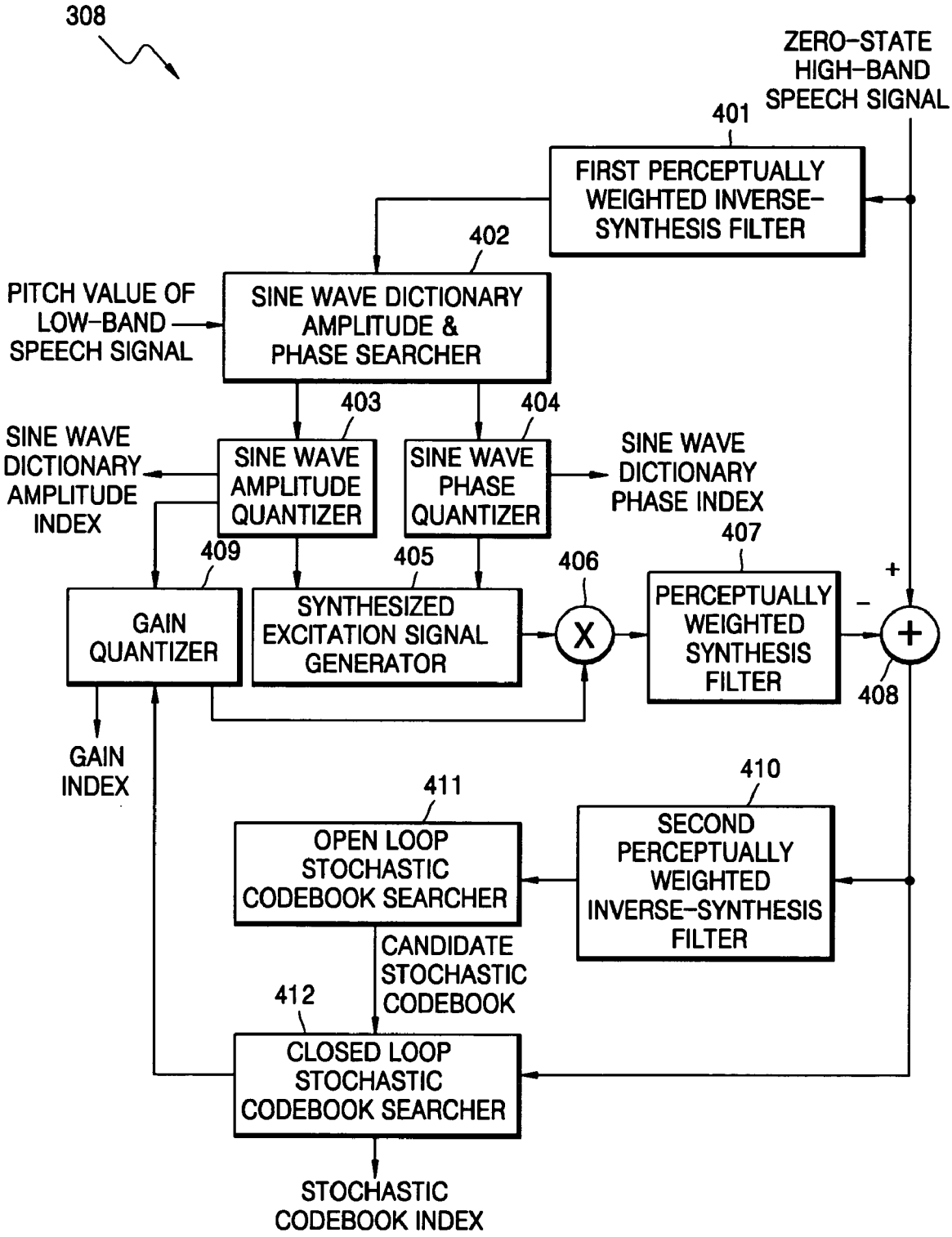
FIG. 4 is a block diagram of a first encoding unit illustrated in FIG. 3.

Referring to FIG. 4, the first encoding unit 308 of FIG. 3 includes a first perceptually weighted inverse-synthesis filter 401, a sine wave dictionary amplitude and phase searcher 402, a sine wave amplitude quantizer 403, a sine wave phase quantizer 404, a synthesized excitation signal generator 405, a multiplier 406, a perceptually weighted synthesis filter 407, a subtractor 408, a gain quantizer 409, a second perceptually weighted inverse-synthesis filter 410, an open loop stochastic codebook searcher 411, and a closed loop stochastic codebook searcher 412.

The first perceptually weighted inverse-synthesis filter 401, the sine wave dictionary amplitude and phase searcher 402, the sine wave amplitude quantizer 403, the sine wave phase quantizer 404, the composite speech exciting signal generator 405, the multiplier 406, the perceptually weighted synthesis filter 407, and the subtractor 408 constitute a harmonic structure. The second perceptually weighted inverse-synthesis filter 410, the open loop stochastic codebook searcher 411, and the closed loop stochastic codebook searcher 412 constitute a stochastic structure.

The first perceptually weighted inverse-synthesis filter 401 receives the perceptually weighted zero-state high-band speech signal and obtains an ideal LPC exciting signal, $r_h$, using Equation 6:

$$r_h(n) = \sum_{i=0}^{L_{sf}} x(i)h'(n-i) \tag{6}$$

wherein x(i) denotes the perceptually weighted zero-state high-band speech signal, and h' (n−i) denotes an impulse response of the first perceptually weighted inverse-synthesis filter 401. The first perceptually weighted inverse-synthesis filter 401 obtains the ideal LPC excitation signal $r_h$ by convoluting x(i) and h' (n−i).

Since the ideal LPC excitation signal $r_h$ is a target signal for searching for an amplitude and phase of a sine wave dictionary, the ideal LPC excited signal is transmitted to the sine wave dictionary amplitude and phase searcher 402.

The sine wave dictionary amplitude and phase searcher 402 searches for the amplitude and phase of the sine wave dictionary using a matching pursuit (MP) algorithm. A harmonic exciting signal, $e_{MP}$, based on a sine wave dictionary may be defined as in Equation 7:

$$e_{MP}(n) = \sum_{k=0}^{K-1} A_k \cos(\omega_k n + \phi_k) \tag{7}$$

wherein $A_k$ denotes the amplitude of a k-th sine wave, $\omega_k$ denotes the angular frequency of the k-th sine wave, $\phi_k$ denotes the phase of the k-th sine wave, and K denotes the number of sine wave dictionaries.

The sine wave dictionary amplitude and phase searcher 402 obtains an angular frequency $\omega_k$ of a sine wave dictionary using a pitch value, $t_p$, of the low-band speech signal provided by the low-band speech encoding apparatus 203 before searching for the amplitude and phase of the sine wave dictionary using the MP algorithm. In other words, the angular frequency $\omega_k$ is obtained using Equation 8:

$$\omega_k = \frac{2\pi}{t_P}\left(k + \frac{t_P}{2}\right) - \pi \tag{8}$$

The sine wave dictionary amplitude and phase searcher 402, which is based on the MP algorithm, searches for the amplitude and phase of a sine wave dictionary by repeating a process of extracting a component amplitude by reflecting a k-th target signal in a k-th dictionary and a process of producing a (k+1)th target signal by applying the extracted component amplitude to the k-th target signal. The search for the amplitude and phase of the sine wave dictionary using the MP algorithm may be defined as in Equation 9:

$$E_k = \sum_{n=0}^{L_{sf}-1} w_{ham}(n)[r_{h,k}(n) - A_k\cos(\omega_k n + \phi_k)]^2 \tag{9}$$

wherein $r_{h,k}$ denotes a k-th target signal, and $E_k$ denotes a value obtained by applying a hamming window $W_{ham}$ to a mean squared error between the k-th object signal $r_{h,k}$ and a k-th sine wave dictionary. If k is 0, the k-th target signal $r_{h,k}$ is the ideal LPC excitation signal. $A_k$ and $\phi_k$ that minimize the value $E_k$ may be given by Equation 10:

$$A_k = \sqrt{a_k^2 + b_k^2},\ \phi_k = -\tan^{-1}\left(\frac{b_k}{a_k}\right) \tag{10}$$

$$a_k = \frac{\sum_{n=0}^{L_{sf}-1}\sin^2(\omega_k n)\sum_{n=0}^{L_{sf}-1} r_{h,k}(n)\cos(\omega_k n) - \sum_{n=0}^{L_{sf}-1}\cos(\omega_k n)\sin(\omega_k n)\sum_{n=0}^{L_{sf}-1} r_{h,k}(n)\sin(\omega_k n)}{\sum_{n=0}^{L_{sf}-1}\cos^2(\omega_k n)\sum_{n=0}^{L_{sf}-1}\sin^2(\omega_k n) - \sum_{n=0}^{L_{sf}-1}\cos(\omega_k n)\sin(\omega_k n)\sum_{n=0}^{L_{sf}-1}\cos(\omega_k n)\sin(\omega_k n)},$$

-continued $$b_k = \frac{\sum_{n=0}^{L_{sf}-1} \cos^2(\omega_k n) \sum_{n=0}^{L_{sf}-1} r_{h,k}(n)\sin(\omega_k n) - \sum_{n=0}^{L_{sf}-1} \cos(\omega_k n)\sin(\omega_k n) \sum_{n=0}^{L_{sf}-1} r_{h,k}(n)\cos(\omega_k n)}{\sum_{n=0}^{L_{sf}-1} \cos^2(\omega_k n) \sum_{n=0}^{L_{sf}-1} \sin^2(\omega_k n) - \sum_{n=0}^{L_{sf}-1} \cos(\omega_k n)\sin(\omega_k n) \sum_{n=0}^{L_{sf}-1} \cos(\omega_k n)\sin(\omega_k n)}$$

After amplitudes and phases of all of the K sine wave dictionaries are found, amplitude vectors of the sine wave dictionaries are output to the sine wave amplitude quantizer 403, and phase vectors of the sine wave dictionaries are output to the sine wave phase quantizer 404.

Figure 5:
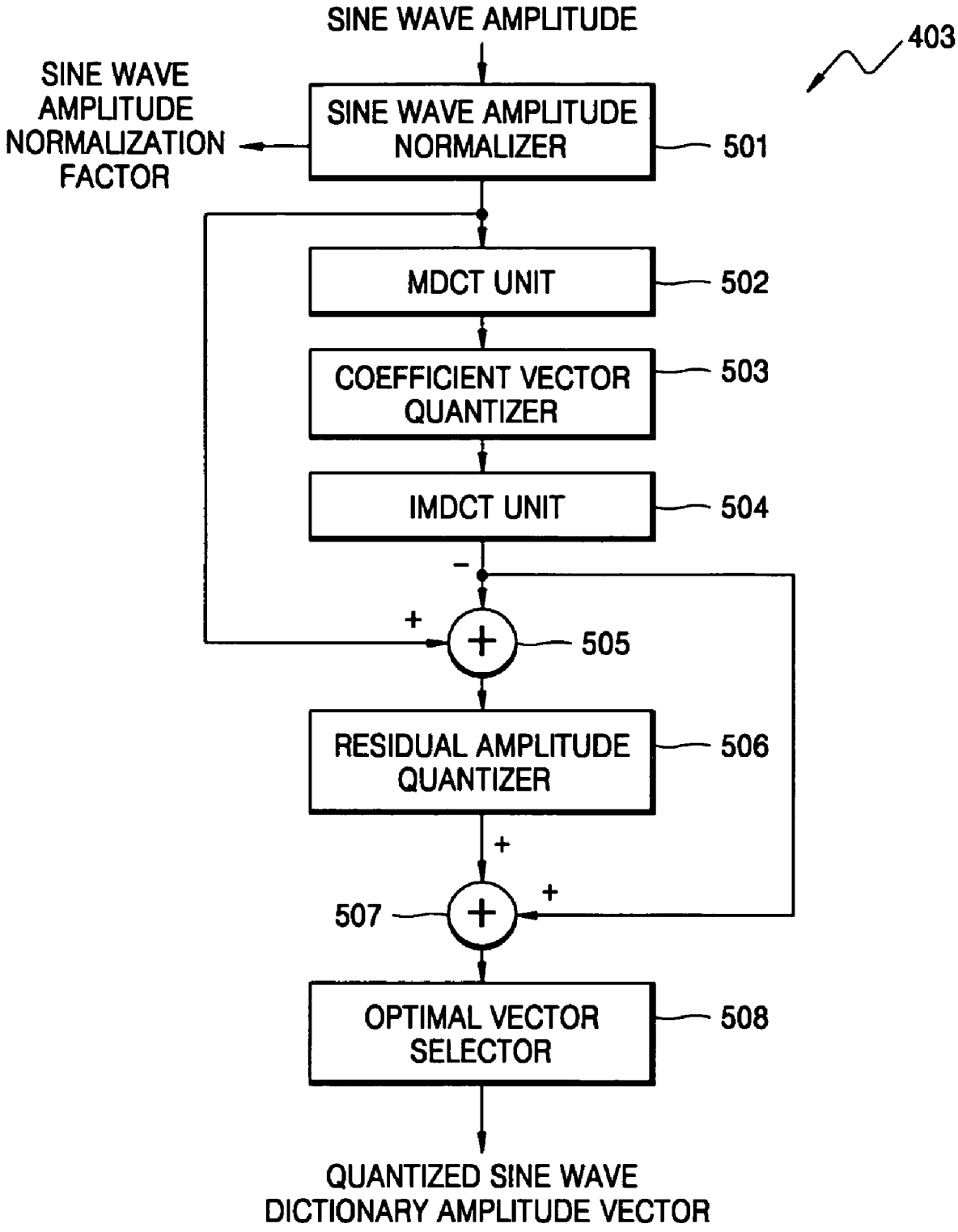
FIG. 5 is a block diagram of a sine wave amplitude quantizer illustrated in FIG. 4.

Referring to FIG. 5, the sine wave amplitude quantizer 403 of FIG. 4 includes a sine wave amplitude normalizer 501, a modulated discrete cosine transform (MDCT) unit 502, a coefficient vector quantizer 503, an inverse MDCT (IMDCT) unit 504, a subtractor 505, a residual amplitude quantizer 506, an adder 507, and an optimal vector selector 508.

The sine wave amplitude normalizer 501 normalizes the sine wave amplitude output from the sine wave dictionary amplitude and phase searcher 402 using Equation 11:

$$A'_k = \frac{A_k}{\sqrt{\sum_{i=0}^{K-1} \frac{A_i^2}{K}}} \tag{11}$$

wherein $A'_k$ denotes the normalized k-th sine wave amplitude, and a sine wave amplitude normalization factor is the denominator of Equation 11. The sine wave amplitude normalization factor is a scalar value and supplied to the gain quantizer 409 of FIG. 4. The normalized k-th sine wave amplitude $A'_k$ is a vector value and provided to the MDCT unit 502 and the subtractor 505.

The MDCT unit 502 performs MDCT on the normalized sine wave amplitude $A'_k$ as shown in Equation 12:

$$C_k = \frac{1}{K}\sum_{n=0}^{K-1} A'_n \lambda(k)\cos\frac{(2n+1)\pi k}{2K}, \tag{12}$$

$$\lambda(i) = \begin{cases} 1 & , i = 0 \\ \sqrt{2} & , \text{otherwise} \end{cases}$$

wherein $C_k$ denotes a k-th DCT coefficient vector of the normalized k-th sine wave amplitude $A'_k$. $A'_n$ in Equation 12 is the normalized k-th sine wave amplitude $A'_k$. The k-th DCT coefficient vector $C_k$ is output to the coefficient vector quantizer 503. The coefficient vector quantizer 503 quantizes the DCT coefficients using a split vector quantization technique and selects an optimal candidate DCT coefficient vectors. At this time, four DCT coefficient vectors may be selected as the optimal candidate DCT coefficient vectors.

The selected candidate DCT coefficient vectors are output to the IMDCT unit 504. The IMDCT unit 504 obtains quantized sine wave amplitude vectors by substituting the selected candidate DCT coefficient vectors into Equation 13:

$$AE_k = \frac{1}{\sqrt{K}}\sum_{n=0}^{K-1}\left[\hat{C}_n \lambda(k)\cos\left(\frac{(2n+1)\pi k}{2K}\right)\right] \tag{13}$$

wherein $AE_k$ denotes a vector obtained by performing IMDCT on a quantized candidate DCT coefficient vector $\hat{c}$, which is a quantized sine wave amplitude vector. The quantized sine wave amplitude vector is output to the subtractor 505.

The subtractor 505 calculates the difference between the normalized sine wave amplitude vector $A'_k$ received from the sine wave amplitude normalizer 501 and the quantized sine wave amplitude vector $AE_k$ as an error vector and transmits the error vector to the residual amplitude quantizer 506.

The residual amplitude quantizer 506 quantizes the received error vector and outputs the quantized error vector to the adder 507. The adder 507 adds the quantized error vector received from the residual amplitude quantizer 506 to an IMDCTed sine wave amplitude vector $AE_k$ corresponding to the quantized error vector to obtain a final quantized sine wave dictionary amplitude vector.

When receiving quantized sine wave dictionary amplitude vectors for the candidate DCT coefficient vectors detected by the MDCT unit 502 from the adder 507, the optimal vector selector 508 selects a quantized sine wave dictionary amplitude vector most similar to the original sine wave dictionary amplitude vector among quantized sine wave dictionary amplitude vectors output by the adder 507 and outputs the selected quantized sine wave dictionary amplitude vectors. The selected quantized sine wave dictionary amplitude vector is transmitted to the composite speech exciting signal generator 405. The selected quantized sine wave dictionary amplitude vector is also transmitted to the channel 210 to serve as a quantized sine wave dictionary amplitude index.

Referring back to FIG. 4, when receiving the phase vector found by the sine wave dictionary amplitude and phase searcher 402, the sine wave phase quantizer 404 quantizes the phase vector using a multi-level vector quantization technique. The sine wave phase quantizer 404 quantizes only half of the phase information to be transmitted in consideration of the fact that a phase at a relatively low frequency is important. The other half of the phase information may be randomly made to be used. The quantized phase vector output by the sine wave phase quantizer 404 is transmitted to the synthesized excitation signal generator 405 and the channel 210. The quantized phase vector is a sine wave dictionary phase index.

The synthesized excitation signal generator 405 outputs a synthesized excitation signal (or a synthesized excitation speech signal) based on the quantized sine wave dictionary amplitude vector received from the sine wave amplitude quantizer 403 and the quantized sine wave dictionary phase vector received from the sine wave phase quantizer 404. In other words, when the quantized sine wave dictionary amplitude vector is $\hat{A}$, and the quantized sine wave dictionary phase vector is $\hat{\phi}$, the synthesized excitation signal generator 405 can obtain a synthesized excitation signal $\hat{r}_h$ as in Equation 14:

$$\hat{r}_h(n) = w_{ham}(n)\sum_{k=0}^{K}\hat{A}_k\cos(\omega_k n + \hat{\phi}_k) \tag{14}$$

The synthesized excitation signal $\hat{r}_h$ is output to the multiplier 406. The multiplier 406 multiplies a quantized sine wave amplitude normalization factor output by the gain quantizer 409 by the synthesized excitation signal $\hat{r}_h$ output by the synthesized excitation signal generator 405 and outputs a result of the multiplication to the perceptually weighted synthesis filter 407.

The perceptually weighted synthesis filter 407 convolutes a harmonic excitation signal, which is the result of the multiplication of the quantized sine wave amplitude normalization factor by the synthesized excitation signal $\hat{r}_h$, and an impulse response h(n) of the perceptually weighted synthesis filter 407 using Equation 15 to obtain a synthesized signal based on a harmonic structure:

$$\hat{s}_h(n) = \hat{g}_h\sum_{i=0}^{L_{sf}}\hat{r}_h(i)h(n-i) \tag{15}$$

wherein $\hat{g}_h$ denotes a quantized sine wave amplitude normalization factor transmitted from the gain quantizer 409 to the multiplier 406. The synthesized signal based on the harmonic structure is output to the subtractor 408.

The subtractor 408 obtains a residual signal by subtracting the synthesized signal based on the harmonic structure received from the perceptually weighted synthesis filter 407 from the received perceptually weighted zero-state high-band speech signal.

The residual signal obtained by the subtractor 408 is used to search for a codebook through an open loop search and a closed loop search. In other words, the residual signal obtained by the subtractor 408 is input to the second perceptually weighted inverse-synthesis filter 410 to perform an open loop search. The second perceptually weighted inverse-synthesis filter 410 produces a second-order ideal excitation signal by convoluting an impulse response of the second perceptually weighted inverse-synthesis filter 410 and the residual signal received from the subtractor 408 using Equation 16:

$$r_s(n) = \sum_{i=0}^{L_{sf}}x_2(i)h'(n-i) \tag{16}$$

wherein $x_2$ denotes the residual signal output by the subtractor 408, and $r_s$ denotes the second-order ideal excitation signal.

The second-order ideal excitation signal produced by the second perceptually weighted inverse-synthesis filter 410 is transmitted to the open loop stochastic codebook searcher 411. The open loop stochastic codebook searcher 411 selects a plurality of candidate stochastic codebooks from stochastic codebooks by using the second-order ideal excitation signal as a target signal. The candidate stochastic codebooks found by the open loop stochastic codebook searcher 411 are transmitted to the closed loop stochastic codebook searcher 412.

The closed loop stochastic codebook searcher 412 produces a speech level signal by convoluting the impulse response of the perceptually weighted synthesis filter 407 and the candidate stochastic codebooks found by the open loop stochastic codebook searcher 411. A gain, $g_s$, between the produced speech level signal, $y_2$, and the residual signal, $x_2$, provided by the subtractor 408 is calculated using Equation 17:

$$g_s = \frac{\sum_{i=0}^{L_{sf}}x_2(i)y_2(i)}{\sum_{i=0}^{L_{sf}}y_2(i)y_2(i)} \tag{17}$$

Then, the closed loop stochastic codebook searcher 412 calculates a mean squared error, $E_{mse}$, from the residual signal $x_2$ and a product of the gain $g_s$ and the speech level signal $y_2$ using Equation 18:

$$E_{mse} = \sum_{i=0}^{L_{sf}-1}(x_2(i) - g_s y_2(i))^2 \tag{18}$$

A candidate stochastic codebook for which the mean squared error is minimal is selected from the candidate stochastic codebooks found by the open loop stochastic codebook searcher 411. A gain corresponding to the selected candidate stochastic codebook is transmitted to the gain quantizer 409 and quantized thereby. An index for the selected candidate stochastic codebook is output as a stochastic codebook index to the channel 210.

The gain quantizer 409 2-dimensionally (2D) vector quantizes the sine wave amplitude normalization factor received from the sine wave amplitude quantizer 403 and the stochastic codebook gain received from the closed loop stochastic codebook searcher 412 and outputs the quantized sine wave amplitude normalization factor to the multiplier 406 and the quantized stochastic codebook gain to the channel 210. The quantized stochastic codebook gain serves as a gain index.

Referring back to FIG. 3, the second encoding unit 309 of FIG. 3 synthesizes an excitation signal and the perceptually weighted zero-state high-band speech signal received from the switch 307, based on a stochastic structure. Hence, the second encoding unit 309 may be defined as an excitation signal synthesizing unit.

Figure 6:
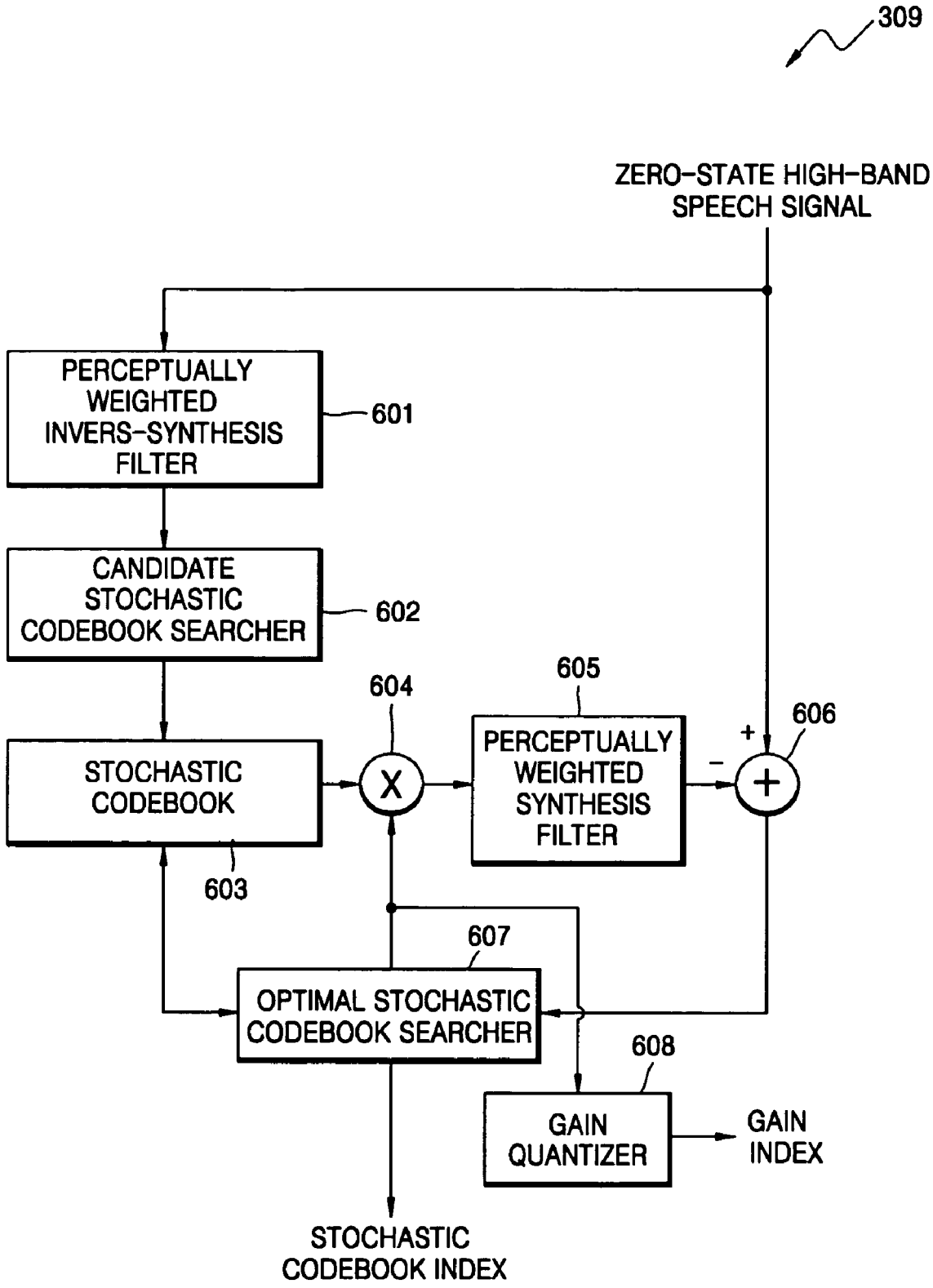
FIG. 6 is a block diagram of a second encoding unit illustrated in FIG. 3.

Referring to FIG. 6, the second encoding unit 309 includes a perceptually weighted inverse-synthesis filter 601, a candidate stochastic codebook searcher 602, a stochastic codebook 603, a multiplier 604, a perceptually weighted synthesis filter 605, a subtractor 606, an optimal stochastic codebook searcher 607, and a gain quantizer 608.

The perceptually weighted inverse-synthesis filter 601 generates the ideal excitation signal $r_s$ by convoluting the received perceptually weighted zero-state high-band speech signal x(i) and an impulse response h'(n) of the perceptually weighted inverse-synthesis filter 601 as shown in Equation 19:

$$r_s(n) = \sum_{i=0}^{L_{sf}-1} x(i)h'(n-i) \tag{19}$$

When receiving the ideal excitation signal $r_s$, the candidate stochastic codebook searcher 602 selects candidate codebooks having high cross correlations by obtaining a cross correlation, c(i), between the ideal excitation signal $r_s(n)$ and each of the stochastic codebooks existing in the stochastic codebook 603 as in Equation 20:

$$c(i) = \sum_{n=0}^{L_{sf}-1} r_s(n)r'_i(n) \tag{20}$$

wherein $r'_i$ (n) denotes an i-th stochastic codebook included in the stochastic codebook 603.

The stochastic codebook 603 may include a plurality of stochastic codebooks.

When receiving the selected candidate stochastic codebooks from the stochastic codebook 603, the multiplier 604 multiplies the selected candidate stochastic codebooks by a gain received from the optimal stochastic codebook searcher 607.

The perceptually weighted synthesis filter 605 convolutes candidate stochastic codebooks multiplied by the gain with an impulse response $h_i(n-j)$ as shown in Equation 21:

$$y(n) = g_i \sum_{j=0}^{L_{sf}-1} r'_i(i)h_i(n-j) \tag{21}$$

wherein $g_i$ denotes the gain provided by the optimal stochastic codebook searcher 607 to the multiplier 604. The perceptually weighted synthesis filter 605 outputs a synthesized signal obtained by convoluting the candidate stochastic codebooks with the impulse response $h_i(n-j)$.

The subtractor 606 outputs to the optimal stochastic codebook searcher 607 a difference signal obtained from the difference between the received perceptually weighted zero-state high-band speech signal and the synthesized signal obtained by the perceptually weighted synthesis filter 605.

Based on the received difference signal, the optimal stochastic codebook searcher 607 searches for an optimal stochastic codebook from the candidate stochastic codebooks found by the candidate stochastic codebook searcher 602.

In other words, the optimal stochastic codebook searcher 607 selects as the optimal stochastic codebook a candidate stochastic codebook corresponding to the smallest difference signal generated by the subtractor 606. The selected stochastic codebook is an optimal excitation signal. A gain corresponding to the optimal stochastic codebook selected by the optimal stochastic codebook searcher 607 is transmitted to the gain quantizer 608 and the multiplier 604.

Also, when the optimal stochastic codebook is selected, the optimal stochastic codebook searcher 607 outputs an index for the selected stochastic codebook to the channel 210 of FIG. 2.

The gain quantizer 608 quantizes the received gain and outputs the quantized gain as a gain index to the channel 210 of FIG. 2.

The high-band speech encoding apparatus 202 of FIG. 2 may perform a function of multiplexing a gain index, a sine wave dictionary amplitude index, a sine wave dictionary phase index, and a stochastic codebook index that are output by the first encoding unit 308, a stochastic codebook index and a gain index that are output by the second encoding unit 309, and an LPC index, and outputting a result of the multiplexing to the channel 210 of FIG. 2. These indices are all required to decode an encoded speech signal.

Referring to FIG. 2, the low-band speech encoding apparatus 203 encodes the received low-band speech signal using a standard narrow-band speech signal compressor. A standard narrow-band speech signal compressor can compress a low-band speech signal having a 0.3-4 kHz frequency range and obtain the pitch value tp of the low-band speech signal. A signal output by the low-band speech encoding apparatus 203 is transmitted to the channel 210.

The channel 210 transmits decoding information received from the high-band and low-band speech encoding apparatuses 202 and 203 to the speech decoding apparatus 220. The decoding information may be transmitted in a packet form.

As shown in FIG. 2, the speech decoding apparatus 220 includes a high-band speech decoding apparatus 221, a low-band speech decoding apparatus 222, and a band combining unit 223.

The high-band speech decoding apparatus 221 outputs a high-band speech signal decoded according to the decoding information received from the channel 210. To do this, the high-band speech decoding apparatus 221 is constructed as shown in FIG. 7.

Figure 7:
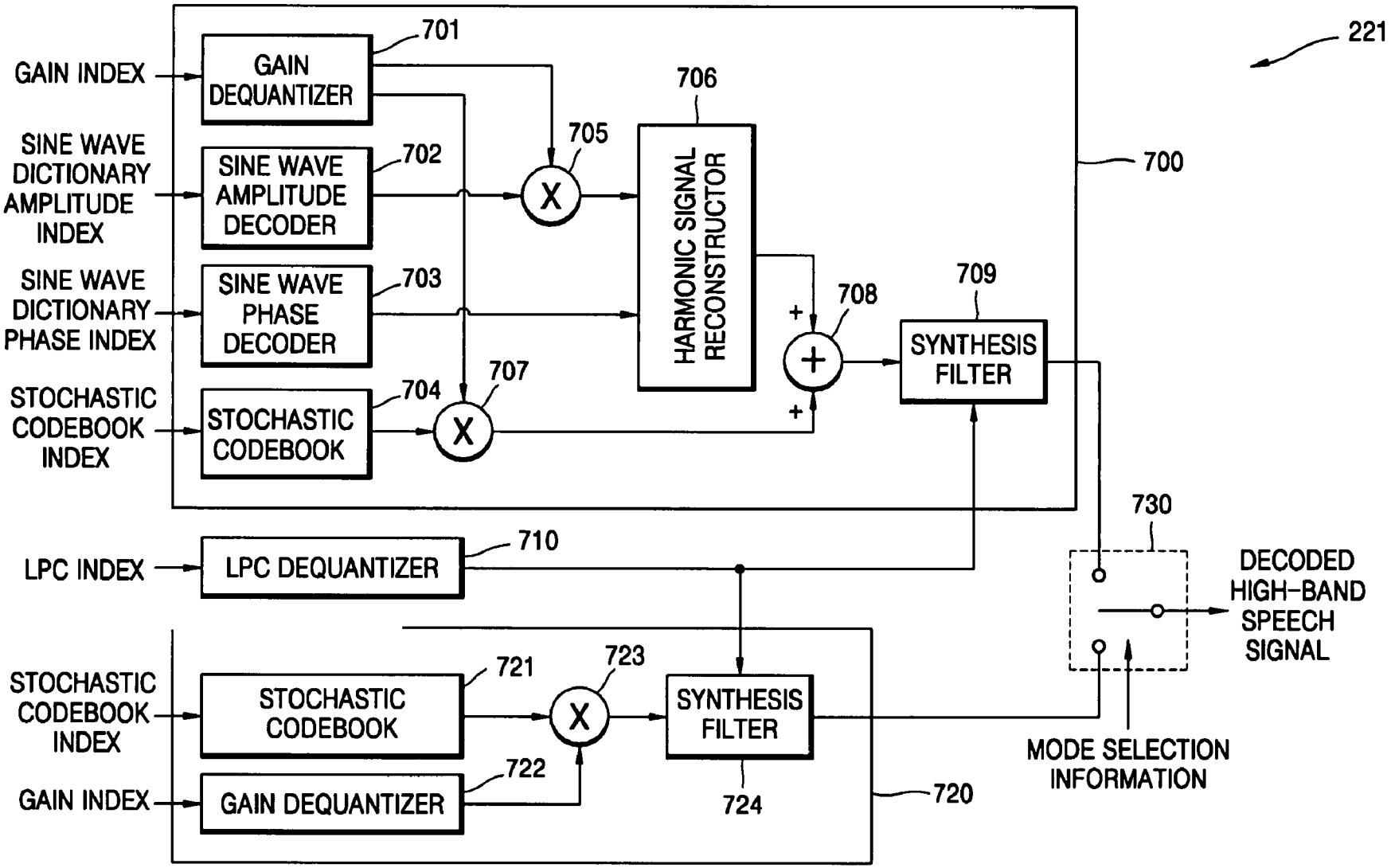
FIG. 7 is a function block diagram of the high-band speech decoding apparatus illustrated in FIG. 2.

Referring to FIG. 7, the high-band speech decoding apparatus 221 of FIG. 2 includes a first decoding unit 700, an LPC dequantizing unit 710, a second decoding unit 720, and a switch 730.

The first decoding unit 700, which is a combination of a harmonic structure and a stochastic structure, decodes an encoded high-band speech signal using the decoding information received via the channel 210 of FIG. 2. Hence, the first decoding unit 700 operates when the mode selection information received via the channel 210 represents a mode in which a harmonic structure and a stochastic structure are combined together. When the mode selection information represents the mode in which a harmonic structure and a stochastic structure are combined together, both a high-band speech signal and a low-band speech signal have harmonic components.

The first decoding unit 700 includes a gain dequantizer 701, a sine wave amplitude decoder 702, a sine wave phase decoder 703, a stochastic codebook 704, multipliers 705 and 707, a harmonic signal reconstructor 706, an adder 708, and a synthesis filter 709.

The gain dequantizer 701 receives the gain index, dequantizes the same, and outputs a quantized sine wave amplitude normalization factor.

The sine wave amplitude decoder 702 receives the sine wave dictionary amplitude index, obtains a quantized sine wave dictionary amplitude for the sine wave dictionary amplitude index through an IMDCT process, decodes the quantized sine wave dictionary amplitude, and adds the decoded sine wave dictionary amplitude to the quantized sine wave dictionary amplitude to detect a quantized sine wave dictionary amplitude.

The sine wave phase decoder 703 receives the sine wave dictionary phase index and outputs a quantized sine wave dictionary phase corresponding to the sine wave dictionary phase index.

The stochastic codebook 704 receives the stochastic codebook index and outputs a stochastic codebook corresponding to the stochastic codebook index. The stochastic codebook 704 may include a plurality of stochastic codebooks.

The multiplier 705 multiplies the quantized normalization factor output from the gain dequantizer 701 by the quantized sine wave dictionary amplitude output from the sine wave amplitude decoder 702.

The harmonic signal reconstructor 706 reconstructs a harmonic signal using a quantized sine wave dictionary amplitude vector, $\hat{A}$, which is a result of the multiplication by the multiplier 705, and a quantized sine wave dictionary phase vector $\hat{\phi}$, using Equation 14. The harmonic signal is output to the adder 708.

The multiplier 707 multiplies the quantized stochastic codebook gain output from the gain dequantizer 701 by the stochastic codebook output from the stochastic codebook 704 to produce an excitation signal.

The adder 708 adds the harmonic signal output by the harmonic signal reconstructor 706 to the excitation signal output by the multiplier 707.

The synthesis filter 709 synthesis-filters a signal output by the adder 708 using a quantized LPC received from the LPC dequantizer 710 and outputs a decoded high-band speech signal. The decoded high-band speech signal is transmitted to the switch 730.

In response to the LPC index, the LPC dequantizer 710 outputs the quantized LPC corresponding to the LPC index. The quantized LPC is transmitted to the synthesis filter 709 and a synthesis filter 724 of the second decoding unit 720 to be described below.

The second decoding unit 720, which has a harmonic structure, produces a decoded high-band speech signal using the decoding information received via the channel 210. Hence, the second decoding unit 720 operates when the mode selection information received via the channel 210 of FIG. 2 represents a harmonic structure mode. When the mode selection information represents a stochastic structure mode, at least one of the high-band speech signal and the low-band speech signal has no harmonic components.

The second decoding unit 720 includes a stochastic codebook 721, a gain dequantizer 722, a multiplier 723, and a synthesis filter 724.

The stochastic codebook 721 receives the stochastic codebook index and outputs a stochastic codebook corresponding to the stochastic codebook index. The stochastic codebook 721 may include a plurality of stochastic codebooks.

The gain dequantizer 722 receives the gain index and outputs a quantized gain corresponding to the gain index.

The multiplier 723 multiplies the quantized gain by the stochastic codebook.

The synthesis filter 724 synthesis-filters a stochastic codebook multiplied by the gain using the quantized LPC received from the LPC dequantizer 710 and outputs a decoded high-band speech signal. The decoded high-band speech signal is transmitted to the switch 730.

The switch 730 transmits one of the decoded high-band speech signals received from the first and second decoding units 700 and 720 according to received mode selection information. In other words, if the received mode selection information represents a combination of a harmonic structure and a stochastic structure, the decoded high-band speech signal received from the first decoding unit 700 is output as a decoded high-band speech signal. If the received mode selection information represents a stochastic structure, the decoded high-band speech signal received from the second decoding unit 720 is output as the decoded high-band speech signal.

Referring to FIG. 2, the high-band speech decoding apparatus 221 may further include a demultiplexer for demultiplexing decoding information received via the channel 210 and transmitting demultiplexed decoding information to a corresponding module.

The low-band speech decoding apparatus 222 decodes the encoded low-band speech signal using decoding information about low-band speech decoding received via the channel 210. The structure of the low-band speech decoding apparatus 222 corresponds to that of the low-band speech encoding apparatus 203.

The band combining unit 223 outputs a decoded speech signal by combining the decoded high-band speech signal output by the high-band speech decoding apparatus 221 and the decoded low-band speech signal output by the low-band speech decoding apparatus 222.

Figure 8:
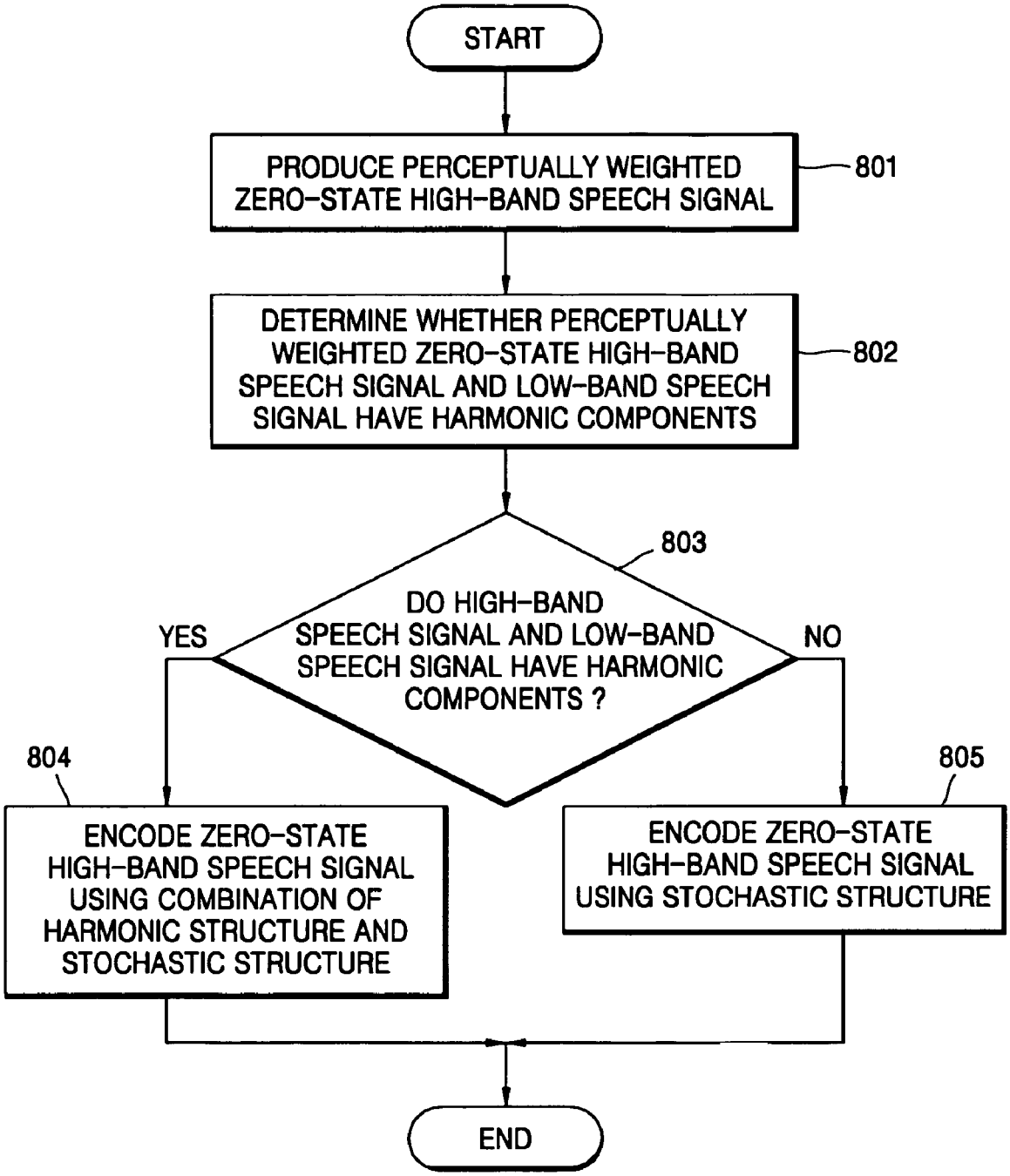
FIG. 8 is a flowchart illustrating a high-band speech encoding method according to an embodiment of the present invention.

FIG. 8 is a flowchart illustrating a high-band speech encoding method according to an embodiment of the present invention. When an input speech signal is divided into a high-band speech signal and a low-band speech signal, a perceptually weighted zero-state high-band speech signal for the high-band speech signal is produced, in operation 801. In other words, the perceptually weighted zero-state high-band speech signal is produced using LPCs detected by LPC analysis on the high-band speech signal and perceptual weighting filters as described above with reference to FIG. 3.

In operation 802, it is determined whether the perceptually weighted zero-state high-band speech signal and the low-band speech signal have harmonic components. More specifically, as described above, the mode selection unit 306 of FIG. 3 detects four characteristic values of individual subframes, compares the detected characteristic values with preset threshold values, and determines whether each speech signal has a harmonic signal if the result of the comparison satisfies a predetermined condition.

If it is determined in operation 803 that the perceptually weighted zero-state high-band speech signal and the low-band speech signal have harmonic components, the zero-state high-band speech signal is encoded using a combination of a harmonic structure and a stochastic structure as described above with reference to FIG. 4, in operation 804.

On the other hand, if it is determined in operation 805 that either of the perceptually weighted zero-state high-band speech signal and the low-band speech signal does not have a harmonic component, the zero-state high-band speech signal is encoded using a stochastic structure as described above with reference to FIG. 6, in operation in 805.

As described above, information used to decode an encoded high-band speech signal is transmitted to a speech signal decoding apparatus or a wideband speech signal decoding apparatus via a channel. At this time, information used to decode an encoded low-band speech signal is also transmitted to the speech signal decoding apparatus or the wideband speech signal decoding apparatus.

Figure 9:
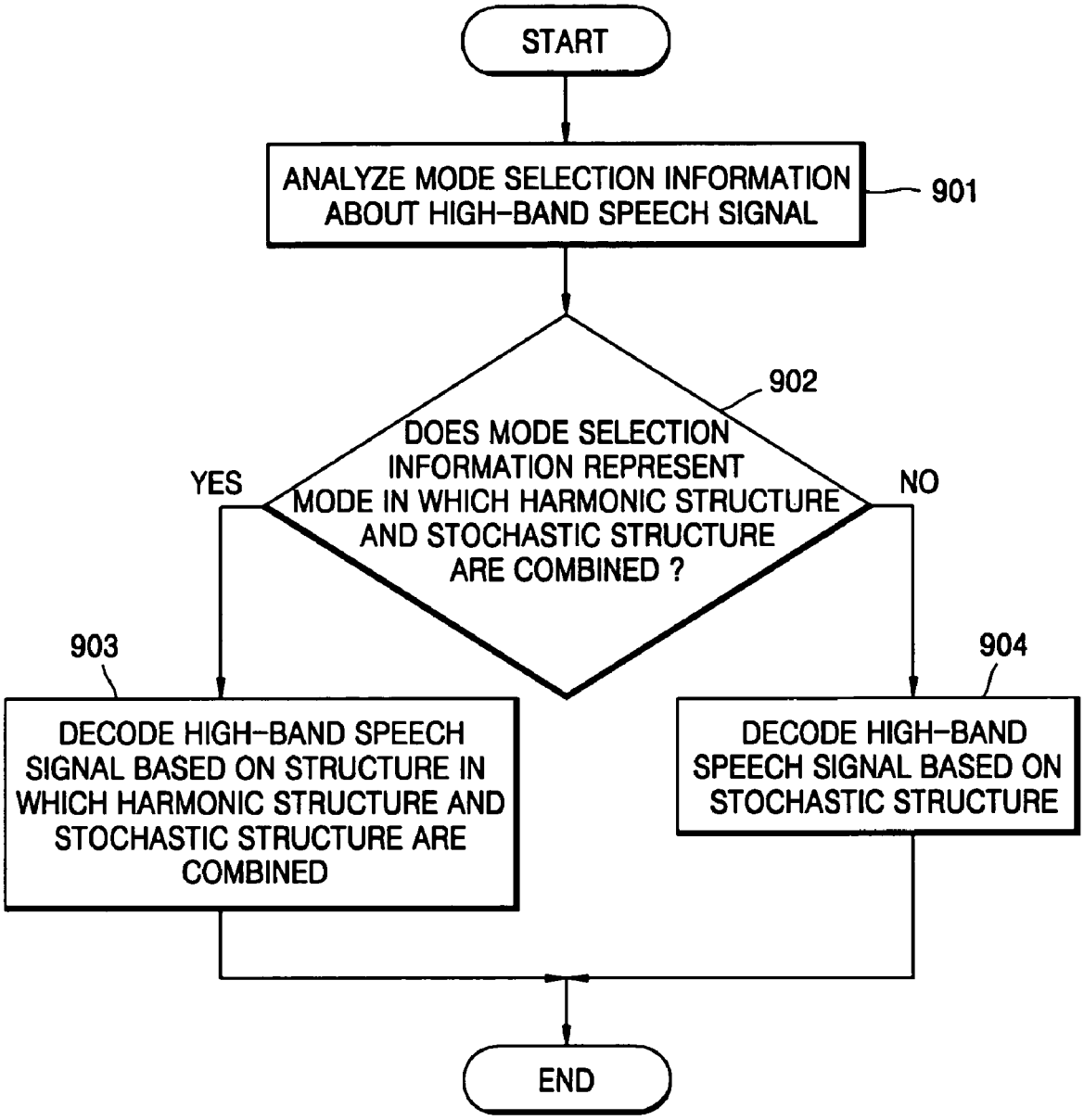
FIG. 9 is a flowchart illustrating a high-band speech decoding method according to an embodiment of the present invention.

FIG. 9 is a flowchart illustrating a high-band speech decoding method according to an embodiment of the present invention. When decoding information relating to high-band speech signal decoding received via a channel includes mode selection information about a high-band speech signal, the mode selection information is analyzed, in operation 901.

If it is determined in operation 902 that the mode selection information represents a mode in which a harmonic structure and a stochastic structure are combined, a high-band speech decoding apparatus, such as, the first decoding unit 700 illustrated in FIG. 7 decodes the high-band speech signal based on a structure in which a harmonic structure and a stochastic structure are combined, in operation 903.

On the other hand, if it is determined in operation 902 that the mode selection information represents a stochastic structure mode, a high-band speech decoding apparatus, such as, the second decoding unit 720 illustrated in FIG. 7, decodes the high-band speech signal based on a stochastic structure, in operation 904.

Programs for executing a high-band speech encoding method and a high-band speech decoding method according to the above-described embodiments of the present invention can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet).

The computer readable recording medium can also be distributed over network coupled computer systems so that the computer readable code is stored and executed in a distributed fashion. Also, functional programs, codes, and code segments for accomplishing the high-band speech encoding and decoding method can be easily construed by programmers skilled in the art to which the present invention pertains.

When a wideband speech encoding and decoding system having a bandwidth extension function according to the above-described embodiments of the present invention performs high-band speech encoding and decoding, if a high-band speech signal and a low-band speech signal have harmonic components, the high-band speech signal is encoded and decoded based on a structure in which a harmonic structure and a stochastic structure is combined. The harmonic structure searches for an amplitude and a phase of a sine wave dictionary using a matching pursuit (MP) algorithm. Hence, the wideband speech encoding and decoding system according to the present invention can reproduce high-quality sound at a low bitrate and with low complexity. Consequently, a narrowband encoding and decoding apparatus having a low transmission rate can be obtained.

In addition, since encoding is based on a harmonic structure using MP sine wave dictionaries, the wideband speech encoding and decoding system is less sensitive to a frequency resolution than when encoding is based on a harmonic structure using fast Fourier transform (FFT).

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

What is claimed is:

1. A high-band speech encoding apparatus in a wideband speech encoding system, the apparatus comprising:

a first encoding unit encoding a high-band speech signal based on a structure in which a harmonic structure and a stochastic structure are combined, when the high-band speech signal has a harmonic component; and a second encoding unit encoding a high-band speech signal based on a stochastic structure when the high-band speech signal has no harmonic components, wherein the first encoding unit includes:

a harmonic structure to generate an excitation signal by searching for an amplitude and a phase of a sine wave dictionary for the high-band speech signal using a matching pursuit algorithm; and a stochastic structure to perform an open loop stochastic codebook search and a closed loop stochastic codebook search using the excitation signal produced using the harmonic structure as a target signal.

2. The high-band speech encoding apparatus of claim 1, wherein the high-band speech signal is a perceptually weighted zero-state high-band speech signal.

3. The high-band speech encoding apparatus of claim 2, wherein the harmonic structure comprises:

a first perceptually weighted inverse-synthesis filter generating an ideal linear prediction residual signal from the perceptually weighted zero-state high-band speech signal;

a searcher using the ideal linear prediction residual signal as the target signal to search for an amplitude and phase of a sine wave dictionary using the matching pursuit algorithm;

a first quantizer quantizing a vector of the sine wave amplitude found by the searcher;

a second quantizer quantizing a vector of the sine wave phase found by the searcher;

a synthesized excitation signal generator generating a synthesized excitation signal based on the quantized sine wave amplitude vector output by the first quantizer and the quantized sine wave phase vector output by the second quantizer;

a third quantizer quantizing a sine wave amplitude normalization factor output by the first quantizer;

a multiplier multiplying the synthesized excitation signal output by the quantized sine wave amplitude normalization factor output from the third quantizer;

a perceptually weighted synthesis filter outputting a synthesis signal obtained by convoluting an impulse response with a signal output by the multiplier; and a subtractor outputting a residual signal equal to the difference between the perceptually weighted zero-state high-band speech signal and the synthesis signal output by the perceptually weighted synthesis filter.

4. The high-band speech encoding apparatus of claim 3, wherein the searcher obtains an angular frequency of the sine wave dictionary using a pitch value of a low-band speech signal corresponding to the perceptually weighted zero-state high-band speech signal and searches for the amplitude and phase of the sine wave dictionary using the angular frequency.

5. The high-band speech encoding apparatus of claim 3, wherein the first quantizer comprises:

a normalizer normalizing the sine wave dictionary amplitude vector and transmitting the sine wave amplitude normalization factor to the third quantizer;

a modulated discrete cosine transform (MDCT) unit outputting discrete cosine transform coefficients obtained by performing MDCT on the sine wave dictionary amplitude vector normalized by the normalizer;

a coefficient vector quantizer quantizing the discrete cosine transform coefficients output by the MDCT unit and outputting at least one candidate discrete cosine transform coefficient;

an inverse modulated discrete cosine transform (IMDCT) unit outputting a quantized sine wave amplitude vector by performing an inverse modulated discrete cosine transformation on the at least one candidate discrete cosine transform coefficient output by the coefficient vector quantizer;

a subtractor detecting a residual amplitude vector between the normalized sine wave dictionary amplitude vector output by the normalizer and the quantized sine wave amplitude vector output by the IMDCT unit;

a residual amplitude quantizer quantizing the residual amplitude vector output by the subtractor;

an adder adding the quantized residual amplitude vector output by the residual amplitude quantizer to the quantized sine wave amplitude vector output by the IMDCT unit; and an optimal vector selector selecting one of the quantized sine wave dictionary amplitude vectors output by the adder using the original sine wave dictionary amplitude vector as an optimal sine wave dictionary amplitude vector, the selected optimal sine wave dictionary amplitude vector being most similar to the original sine wave dictionary amplitude vector.

6. The high-band speech encoding apparatus of claim 3, wherein the first quantizer outputs a sine wave dictionary amplitude index as decoding information used to decode the high-band speech signal, and the second quantizer outputs a sine wave dictionary phase index as decoding information used to decode the high-band speech signal.

7. The high-band speech encoding apparatus of claim 3, wherein the stochastic structure comprises:

a second perceptually weighted inverse-synthesis filter producing an ideal excitation signal by convoluting the residual signal output by the subtractor with an impulse response;

an open loop stochastic codebook searcher selecting at least one candidate stochastic codebook from a stochastic codebook by using the ideal excitation signal output by the second perceptually weighted inverse-synthesis filter as the target signal; and a closed loop stochastic codebook searcher selecting one of the at least one candidate stochastic codebooks using the residual signal output by the subtractor and transmitting a gain of the selected candidate stochastic codebook to the third quantizer, the third quantizer 2-dimensionally vector quantizes the sine wave amplitude normalization factor and the gain output by the closed loop stochastic codebook searcher and outputs the quantized gain as a gain index, the gain index being the decoding information used to decode the high-band speech signal.

8. The high-band speech encoding apparatus of claim 7, wherein the closed loop stochastic codebook searcher produces a speech level signal by convoluting the impulse response of the perceptually weighted synthesis filter with the at least one candidate stochastic codebook, obtains a mean squared error for the at least one candidate stochastic codebook using a gain between the speech level signal and the residual signal output by the subtractor, the speech level signal, and the residual signal, and selects the stochastic codebook having the smallest mean squared error.

9. The high-band speech encoding apparatus of claim 1, wherein the second encoding unit comprises:

a first searcher selecting at least one candidate stochastic codebook for the high-band speech signal;

a second searcher selecting an optimal candidate stochastic codebook from the at least one candidate stochastic codebook selected by the first searcher and producing an index for the selected optimal candidate stochastic codebook, wherein the index for the selected optimal candidate stochastic codebook is decoding information necessary for decoding the encoded high-band speech signal.

10. The high-band speech encoding apparatus of claim 9, wherein the high-band speech signal is a perceptually weighted zero-state high-band speech signal.

11. The high-band speech encoding apparatus of claim 10, wherein the second encoding unit further comprises:

a perceptually weighted inverse-synthesis filter producing an ideal excitation signal by convoluting the perceptually weighted zero-state high-band speech signal with an impulse response, and transmitting the ideal excitation signal to the first searcher;

a stochastic codebook including a plurality of stochastic codebooks and outputting the at least one candidate stochastic codebook selected by the first searcher and the optimal candidate stochastic codebook selected by the second searcher;

a multiplier multiplying the at least one stochastic codebook output by the stochastic codebook by the gain received by the second searcher;

a perceptually weighted synthesis filter generating a synthesized signal by convoluting an impulse response with a signal output by the multiplier;

a subtractor outputting a difference between the synthesized signal output by the perceptually weighted synthesis filter and the perceptually weighted zero-state high-band speech a gain quantizer quantizing a gain output by the second searcher and outputting the quantized gain as a gain index, the gain index being decoding information necessary for decoding the encoded high-band speech signal.

12. The high-band speech encoding apparatus of claim 1, wherein a determination of whether the high-band speech signal has the harmonic component is made based on a sharpness rate, a left-to-right energy ratio, a zero-crossing rate, and a first-order prediction coefficient of each sub-frame of the high-band speech signal.

13. The high-band speech encoding apparatus of claim 1, further comprising:

a switch transmitting the high-band speech signal to either the first encoding unit or second encoding unit; and a mode selection unit determining whether the high-band speech signal has the harmonic component and outputting mode selection information for controlling the switch according to a result of the determination.

14. The high-band speech encoding apparatus of claim 13, wherein the mode selection unit detects the sharpness rate, the left-to-right energy ratio, the zero-crossing rate, and the first-order prediction coefficient of each sub-frame of the high-band speech signal, compares the detected sharpness rate, the left-to-right energy ratio, the zero-crossing rate, and the first-order prediction coefficient of each sub-frame of the high-band speech signal with pre-set threshold values, determining that the high-band speech signal has the harmonic component when a result of the comparison satisfies a pre-set condition, and determining that the high-band speech signal has no harmonic components when the result of the comparison does not satisfy the pre-set condition.

15. The high-band speech encoding apparatus of claim 13, wherein the mode selection unit further determines whether a low-band speech signal corresponding to the high-band speech signal has the harmonic component, and controls the switch to transmit the high-band speech signal to the first encoding unit when it is determined that both the high-band speech signal and the low-band speech signal have harmonic components.

16. The high-band speech encoding apparatus of claim 15, wherein the mode selection unit detects the sharpness rate, the left-to-right energy ratio, the zero-crossing rate, and the first-order prediction coefficient of each sub-frame of each of the high-band speech signal and the low-band speech signal, compares the detected sharpness rate, the left-to-right energy ratio, the zero-crossing rate, and the first-order prediction coefficient of each sub-frame of each of the high-band speech signal and the low-band speech signal with pre-set threshold values, determining that both the high-band speech signal and the low-band speech signal have harmonic components when results of the comparisons for the high-band and low-band speech signals satisfy pre-set conditions, and outputs mode selection information that makes the switch to transmit the high-band speech signal to the second encoding unit when at least one of the results of the comparisons does not satisfy the pre-set condition.

17. The high-band speech encoding apparatus of claim 16, wherein the high-band speech signal is a perceptually weighted zero-state high-band speech signal.

18. The high-band speech encoding apparatus of claim 17, further comprising a production unit producing the perceptually weighted zero-state high-band speech signal.

19. The high-band speech encoding apparatus of claim 18, wherein the production unit comprises:

a linear prediction coefficient analyzer obtaining linear prediction coefficients from a high-band speech signal;

a quantizer quantizing the linear prediction coefficients output by the linear prediction coefficient analyzer;

a perceptually weighted synthesis filter outputting a response signal for an input "0" according to the quantized linear prediction coefficients output by the quantizer;

a perceptual weighting filter outputting a perceptually weighted speech signal of the high-band speech signal using the linear prediction coefficients obtained by the linear prediction coefficient analyzer; and a subtractor outputting the perceptually weighted zero-state high-band speech signal by removing the response signal for the input "0" received from the perceptually weighted speech signal output by the perceptual weighting filter.

20. The high-band speech encoding apparatus of claim 1, further comprising a production unit producing the perceptually weighted zero-state high-band speech signal.

21. A wideband speech encoding system comprising:

a band division unit dividing a speech signal into a high-band speech signal and a low-band speech signal;

a low-band speech signal encoding apparatus encoding the low-band speech signal received from the band division unit and outputting a pitch value of the low-band speech signal that is detected through the encoding; and a high-band speech signal encoding apparatus encoding the high-band speech signal using the high-band and low-band speech signals received from the band division unit and the pitch value of the low-band speech signal, wherein the high-band speech signal encoding apparatus encodes the high-band speech signal based on a combination of a harmonic structure and a stochastic structure when the high-band and low-band speech signals have harmonic components and encodes the high-band speech signal based on a stochastic structure when any one of the high-band and low-band speech signals does not have a harmonic component.

22. A high-band speech decoding apparatus comprising:

a first decoding unit decoding a high-band speech signal based on a combination of a harmonic structure and a stochastic structure using received first decoding information;

a second decoding unit decoding the high-band speech signal based on a stochastic structure using received second decoding information; and a switch outputting one of the decoded high-band speech signals received from the first and second decoding units according to received mode selection information, wherein the high-band speech signal, based on the combination of the harmonic structure and the stochastic structure, is based on an encoding harmonic structure, corresponding to the first decoding information, generating an excitation signal by searching for an amplitude and a phase of a sine wave dictionary for the high-band speech signal using a matching pursuit algorithm, and an encoding stochastic structure, corresponding to the first decoding information, performing an open loop stochastic codebook search and a closed loop stochastic codebook search using the excitation signal produced using the encoding harmonic structure as a target signal.

23. The high-band speech decoding apparatus of claim 22, wherein the first decoding information includes a sine wave dictionary amplitude index, a sine wave dictionary phase index, and a stochastic codebook index, and the second decoding information includes a stochastic codebook index and a gain index.

24. The high-band speech decoding apparatus of claim 23, further comprising a linear prediction coefficient dequantization unit obtaining quantized linear prediction coefficients by dequantizing a received linear prediction coefficient index and transmitting the quantized linear prediction coefficients to the first and second decoding units.

25. The high-band speech decoding apparatus of claim 22, further comprising a linear prediction coefficient dequantization unit obtaining quantized linear prediction coefficients by dequantizing a received linear prediction coefficient index and transmitting the quantized linear prediction coefficients to the first and second decoding units.

26. The high-band speech decoding apparatus of claim 23, wherein the first decoding unit comprises:

a gain dequantizer dequantizing the gain index and outputting a quantized gain;

a sine wave amplitude decoder decoding the sine wave dictionary amplitude index to output a quantized sine wave dictionary amplitude vector;

a sine wave phase decoder decoding the sine wave dictionary phase index to output a quantized sine wave dictionary phase vector;

a stochastic codebook outputting a stochastic codebook corresponding to the stochastic codebook index;

a first multiplier multiplying the quantized gain by the quantized sine wave dictionary amplitude vector;

a second multiplier multiplying the quantized gain by the stochastic codebook to produce an excitation signal;

a harmonic signal reconstructor reconstructing a harmonic signal using a signal output by the first multiplier and the quantized sine wave dictionary amplitude vector;

an adder adding the harmonic signal output by the harmonic signal reconstructor to the excitation signal output by the second multiplier; and a synthesis filter synthesis-filtering a signal output by the adder using the linear prediction coefficients to output the decoded high-band speech signal.

27. The high-band speech decoding apparatus of claim 23, wherein the second decoding unit comprises:

a stochastic codebook receiving the stochastic codebook index and outputting a stochastic codebook corresponding to the stochastic codebook index;

a gain dequantizer receiving the gain index and dequantizing the gain index to output a quantized gain;

a multiplier multiplying the quantized gain by the stochastic codebook to produce an excitation signal; and a synthesis filter synthesis-filtering a signal output by the multiplier using the linear prediction coefficients.

28. A wideband speech decoding system comprising:

a high-band speech signal decoding apparatus decoding a high-band speech signal using decoding information received via a channel using one of a stochastic structure and a combination of a harmonic structure and the stochastic structure;

a low-band speech signal decoding apparatus decoding a low-band speech signal using decoding information received via the channel; and a band combination unit combining the decoded high-band speech signal with the decoded low-band speech signal to output a decoded speech signal, wherein the high-band speech signal, based on the combination of the harmonic structure and the stochastic structure, is based on an encoding harmonic structure, corresponding to the harmonic structure, generating an excitation signal by searching for an amplitude and a phase of a sine wave dictionary for the high-band speech signal using a matching pursuit algorithm, and an encoding stochastic structure, corresponding to the stochastic structure, performing an open loop stochastic codebook search and a closed loop stochastic codebook search using the excitation signal produced using the encoding harmonic structure as a target signal.

29. A high-band speech encoding method in a wideband speech encoding system, comprising:

determining whether a high-band speech signal and a low-band speech signal have harmonic components;

encoding the high-band speech signal based on a combination of a harmonic structure and a stochastic structure when both the high-band and low-band speech signals have harmonic components; and encoding the high-band speech signal based on a stochastic structure when any one of the high-band and low-band speech signals does not have a harmonic component.

30. The high-band speech encoding method of claim 29, wherein the determining whether the high-band speech signal and the low-band speech signal have harmonic components comprises:

detecting characteristic values of each of a plurality of subframes of which the high-band and low-band speech signals are comprised;

comparing the detected characteristic values with pre-set threshold values;

determining that a corresponding speech signal has a harmonic component when a result of the comparison satisfies a predetermined condition; and determining that a corresponding speech signal does not have a harmonic component when the result of the comparison does not satisfy a predetermined condition.

31. The high-band speech encoding method of claim 30, wherein the characteristic values include a sharpness rate, a left-to-right energy ratio, a zero-crossing rate, and a first-order prediction coefficient, and the pre-set threshold values include threshold values of the characteristic values.

32. The high-band speech encoding method of claim 31, wherein the high-band speech signal is a perceptually weighted zero-state high-band speech signal.

33. The high-band speech encoding method of claim 29, wherein the high-band speech signal is a perceptually weighted zero-state high-band speech signal.

34. The high-band speech encoding method of claim 29, wherein the harmonic structure produces an exciting signal by searching for an amplitude and phase of a sine wave dictionary for the high-band speech signal according to a matching pursuit algorithm.

35. A high-band speech decoding method, comprising:

analyzing mode selection information included in received decoding information;

decoding a high-band speech signal based on the received decoding information using a combination of a harmonic structure and a stochastic structure when the mode selection information represents a mode in which a harmonic structure and a stochastic structure are combined; and decoding the high-band speech signal based on the received decoding information using a stochastic structure when the mode selection information represents a stochastic structure, wherein the high-band speech signal, based on the received decoding information using the combination of the harmonic structure and the stochastic structure, is based on an encoding harmonic structure, corresponding to the mode in which the harmonic structure and a stochastic structure are combined, generating an excitation signal by searching for an amplitude and a phase of a sine wave dictionary for the high-band speech signal using a matching pursuit algorithm, and an encoding stochastic structure, corresponding to the mode in which the harmonic structure and a stochastic structure are combined, performing an open loop stochastic codebook search and a closed loop stochastic codebook search using the excitation signal produced using the encoding harmonic structure as a target signal.

* * * * *

UNITED STATES PATENT AND TRADEMARK OFFICE

CERTIFICATE OF CORRECTION

PATENT NO. : 7,801,733 B2
APPLICATION NO. : 11/285183
DATED : September 21, 2010
INVENTOR(S) : Kangeun Lee et al.

It is certified that error appears in the above-identified patent and that said Letters Patent is hereby corrected as shown below:

Column 20, Line 29 after "speech" insert -- signal; and --.

Signed and Sealed this

Twenty-first Day of December, 2010

David J. Kappos

David J. Kappos
*Director of the United States Patent and Trademark Office*